US011209846B2

(12) United States Patent
Satou et al.

(10) Patent No.: US 11,209,846 B2
(45) Date of Patent: Dec. 28, 2021

(54) SEMICONDUCTOR DEVICE HAVING PLURAL POWER SOURCE VOLTAGE GENERATORS, AND VOLTAGE SUPPLYING METHOD

(71) Applicant: Kioxia Corporation, Tokyo (JP)

(72) Inventors: Kazuhiko Satou, Yokohama Kanagawa (JP); Tomonori Kurosawa, Zama Kanagwa (JP); Dai Nakamura, Fujisawa Kanagawa (JP)

(73) Assignee: KIOXIA CORPORATION, Tokyo (JP)

( * ) Notice: Subject to any disclaimer, the term of this patent is extended or adjusted under 35 U.S.C. 154(b) by 0 days.

(21) Appl. No.: 16/941,801

(22) Filed: Jul. 29, 2020

(65) Prior Publication Data

US 2021/0080984 A1 Mar. 18, 2021

(30) Foreign Application Priority Data

Sep. 12, 2019 (JP) ..... JP2019-166239

(51) Int. Cl.
*G05F 1/46* (2006.01)
*G05F 1/648* (2006.01)

(52) U.S. Cl.
CPC ..... *G05F 1/468* (2013.01); *G05F 1/648* (2013.01)

(58) Field of Classification Search
CPC ..... G05F 1/00; G05F 1/10; G05F 1/12; G05F 1/46; G05F 1/455; G05F 1/45; G05F 1/445; G05F 1/66; G05F 1/40; G05F 1/42; G05F 1/44; G05F 1/462; G05F 1/52; G05F 1/56; G05F 3/10; G05F 3/16; G05F 3/18; G05F 3/185; G05F 3/20; G05F 3/26; G05F 3/30; G05F 3/205; G05F 3/22; G05F 3/24; G05F 3/222; G05F 3/242; G05F 3/225;
(Continued)

(56) References Cited

U.S. PATENT DOCUMENTS 5,838,145 A * 11/1998 Poon ..... H02M 1/4208 323/266
5,963,439 A * 10/1999 Wuidart ..... H02M 3/1584 363/46

(Continued)

FOREIGN PATENT DOCUMENTS

JP 2019053799 A 4/2019

*Primary Examiner* — Thienvu V Tran
*Assistant Examiner* — Nusrat Quddus
(74) *Attorney, Agent, or Firm* — Holtz, Holtz & Volek PC

(57) ABSTRACT

In one embodiment, a semiconductor device includes a reference voltage supply circuit configured to supply a first reference voltage and a second reference voltage. The device further includes a power source voltage supply circuit including a first power source voltage generator supplied with the first reference voltage and configured to generate a first power source voltage, and a second power source voltage generator supplied with the second reference voltage and configured to generate a second power source voltage, the power source voltage supply circuit being configured to supply the first power source voltage and the second power source voltage to a power source voltage line. The device further includes a voltage control circuit connected to the power source voltage line, and configured to control a value of the first reference voltage and a value the second reference voltage.

16 Claims, 7 Drawing Sheets

(58) Field of Classification Search
CPC ..... G05F 3/227; G05F 3/245; G05F 3/247; G05F 3/262; G05F 3/265; G05F 3/267; G05F 1/575; H02M 5/2573; H02M 1/081; H02M 5/293; H02M 7/12; H02M 3/10; H02M 3/125; H02M 3/13; H02M 3/135; H02M 3/145; H02M 3/15; H02M 3/155; H02M 3/156; H02M 3/158; H02M 3/1588; H02M 2003/1566; H02M 3/1582; H02M 2003/1557; H05B 39/048; H04B 2215/069; B23K 11/24
See application file for complete search history.

(56) References Cited

U.S. PATENT DOCUMENTS 6,023,133 A * 2/2000 Leung ..... H04N 3/233 315/368.17
6,339,344 B1 * 1/2002 Sakata ..... H03K 19/018528 326/83
6,424,134 B2 * 7/2002 Morishita ..... G05F 1/465 323/313
6,683,442 B1 * 1/2004 Ferencz ..... H02M 3/33592 323/274
7,312,652 B2 * 12/2007 Brox ..... G05F 1/465 323/266
7,411,183 B2 * 8/2008 Overney ..... H01J 49/0418 250/282
7,852,248 B1 * 12/2010 Keramat ..... H03M 3/372 341/143
8,531,171 B1 * 9/2013 Sutardja ..... G05F 3/30 323/314
8,816,658 B1 * 8/2014 De Vita ..... G05F 1/575 323/275
9,958,889 B2 * 5/2018 Pons ..... H02J 7/0068
10,325,667 B2 6/2019 Bushnaq et al.
2001/0006342 A1 * 7/2001 Kusumoto ..... H02M 3/155 323/355
2001/0011886 A1 * 8/2001 Kobayashi ..... G05F 1/465 323/281
2001/0028282 A1 * 10/2001 Nishibe ..... H03H 11/245 333/81 R
2003/0052661 A1 * 3/2003 Tachimori ..... G05F 3/242 323/313
2003/0080795 A1 * 5/2003 Okamoto ..... G11C 7/1087 327/333
2004/0071191 A1 * 4/2004 Sim ..... G01K 7/015 374/185
2004/0185814 A1 * 9/2004 Inamori ..... H03G 3/3036 455/232.1
2005/0099224 A1 * 5/2005 Itoh ..... G05F 1/565 327/541
2006/0158165 A1 * 7/2006 Inn ..... H02M 3/1588 323/280
2007/0018623 A1 * 1/2007 Lopata ..... G05F 1/575 323/282
2007/0024363 A1 * 2/2007 Cho ..... H03F 1/0283 330/124 R
2007/0285152 A1 * 12/2007 Fujita ..... G05F 1/56 327/541
2008/0136396 A1 * 6/2008 Heilmann ..... G05F 1/56 323/298
2008/0174290 A1 * 7/2008 Ogiwara ..... G11C 11/4074 323/282
2009/0290428 A1 * 11/2009 Noh ..... G11C 16/30 365/185.22
2011/0215781 A1 * 9/2011 Sasaki ..... G05F 1/10 323/283
2011/0260783 A1 * 10/2011 Kawasaki ..... G06F 1/3296 327/540
2011/0279101 A1 * 11/2011 Sasaki ..... H02M 1/32 323/271
2012/0062275 A1 * 3/2012 Hiraki ..... H04L 25/0278 326/30
2012/0169305 A1 * 7/2012 Kwon ..... G05F 3/24 323/268
2012/0212201 A1 * 8/2012 Lee ..... H02M 3/073 323/282
2013/0113447 A1 * 5/2013 Kadanka ..... G05F 1/56 323/280
2013/0162227 A1 * 6/2013 Kodama ..... G05F 1/62 323/234
2013/0214869 A1 * 8/2013 Matsuzaki ..... H03L 1/04 331/70
2013/0271095 A1 * 10/2013 Jackum ..... G05F 1/56 323/270
2014/0003164 A1 * 1/2014 Fifield ..... G11C 8/08 365/189.09
2014/0167719 A1 * 6/2014 Chu ..... H02M 3/07 323/282
2014/0191742 A1 * 7/2014 Kung ..... G05F 1/10 323/282
2014/0266118 A1 * 9/2014 Chern ..... H02M 3/156 323/283
2014/0347130 A1 * 11/2014 Iijima ..... H03F 3/45475 330/288
2015/0042306 A1 * 2/2015 Kim ..... G05F 1/561 323/350
2015/0130439 A1 * 5/2015 Wang ..... H03H 7/40 323/299
2016/0116926 A1 * 4/2016 Kim ..... G05F 1/56 323/281
2016/0276265 A1 * 9/2016 Iwabuchi ..... H01L 27/0248
2016/0276287 A1 * 9/2016 Iwabuchi ..... H01L 24/06
2017/0241807 A1 * 8/2017 Hatakeyama ..... H03F 3/45475
2017/0365336 A1 * 12/2017 Lin ..... G11C 13/004
2019/0155323 A1 * 5/2019 Kim ..... H03F 3/45475
2021/0041509 A1 * 2/2021 Jiang ..... G01R 33/072

* cited by examiner

SEMICONDUCTOR DEVICE HAVING PLURAL POWER SOURCE VOLTAGE GENERATORS, AND VOLTAGE SUPPLYING METHOD

CROSS REFERENCE TO RELATED APPLICATION

This application is based upon and claims the benefit of priority from the prior Japanese Patent Application No. 2019-166239, filed on Sep. 12, 2019, the entire contents of which are incorporated herein by reference.

FIELD

Embodiments described herein relate to a semiconductor device and a voltage supplying method.

BACKGROUND

When plural power source voltage generators (VDD generators) in a semiconductor device are simultaneously trimmed, the trimming may be made inappropriate.

DETAILED DESCRIPTION OF THE INVENTION

Figure 1:
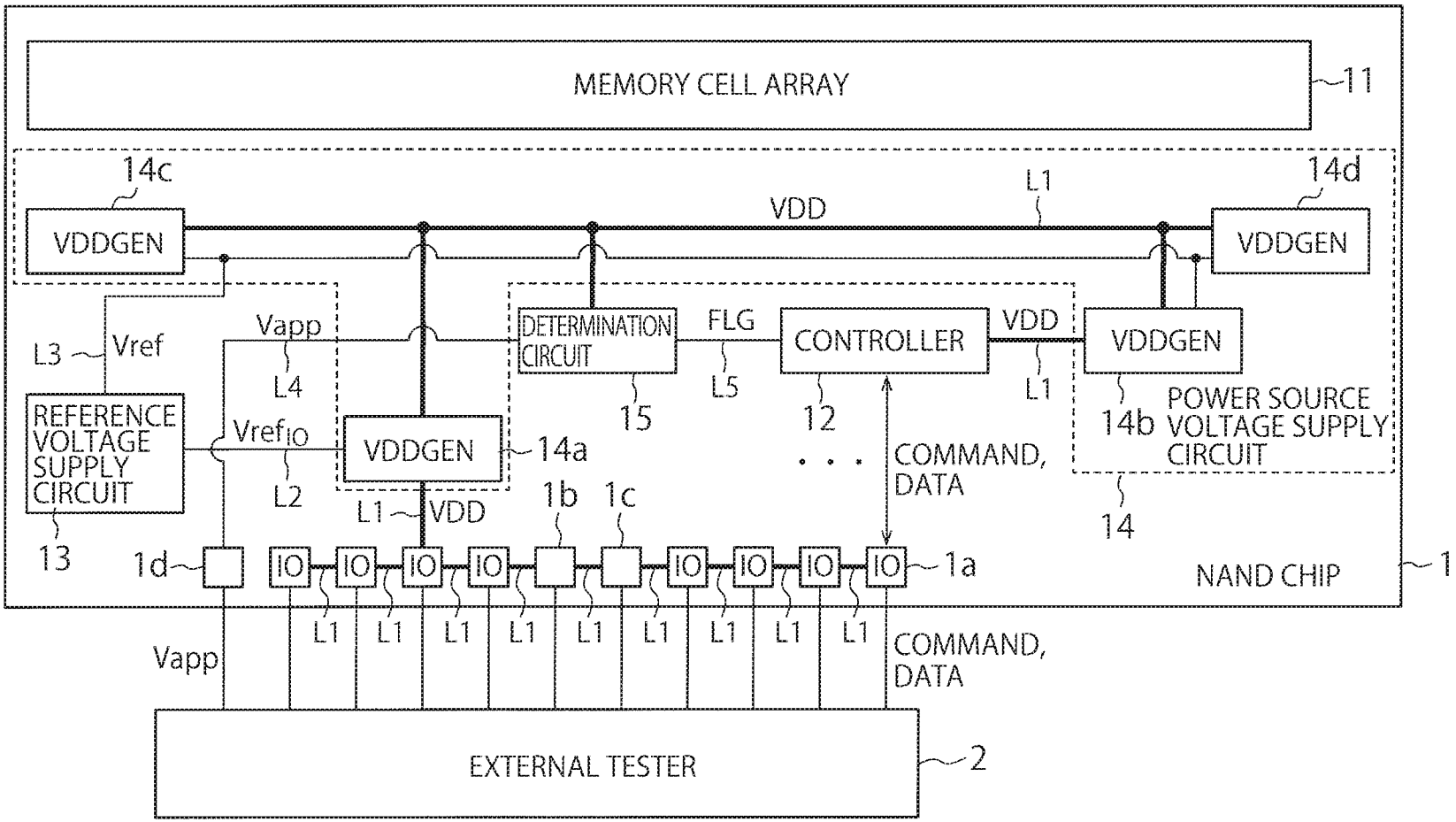
FIG. 1 is a circuit diagram illustrating a configuration of a NAND chip of a first embodiment.

In one embodiment, a semiconductor device includes a reference voltage supply circuit configured to supply a first reference voltage and a second reference voltage. The device further includes a power source voltage supply circuit including a first power source voltage generator supplied with the first reference voltage and configured to generate a first power source voltage, and a second power source voltage generator supplied with the second reference voltage and configured to generate a second power source voltage, the power source voltage supply circuit being configured to supply the first power source voltage and the second power source voltage to a power source voltage line. The device further includes a voltage control circuit connected to the power source voltage line, and configured to control a value of the first reference voltage and a value the second reference voltage.

Embodiments will now be explained with reference to the accompanying drawings. In FIGS. 1 to 7B, the same components are denoted by the same reference numerals, and redundant description will not be repeated.

First Embodiment

FIG. 1 is a circuit diagram illustrating a configuration of a NAND chip 1 of a first embodiment. FIG. 1 illustrates the NAND chip 1 as an example of a semiconductor device, and a tester 2 connected to the NAND chip 1. In the present embodiment, the tester 2 is used to perform trimming processing for the NAND chip 1.

The NAND chip 1 includes a plurality of input/output (I/O) pads 1*a*, RE and BRE (read enable) pads 1*b* and 1*c*, and an applied voltage pad 1*d*. The IO pads 1*a* are used for inputting commands from the tester 2 to the NAND chip 1, and outputting data from the NAND chip 1 to the tester 2. The RE pad 1*b* is used for supplying a RE signal from the tester 2 to the NAND chip 1. The BRE pad 1*c* is used for supplying a BRE signal from the tester 2 to the NAND chip 1. The applied voltage pad 1*d* is used for supplying an applied voltage Vapp from the tester 2 to the NAND chip 1.

The NAND chip 1 further includes a memory cell array 11 including a plurality of memory cells, a controller 12 that controls operations of the NAND chip 1, a reference voltage supply circuit 13, a power source voltage supply circuit 14, and a determination circuit 15. The power source voltage supply circuit 14 includes a plurality of VDD generators 14*a* to 14*d*. The NAND chip 1 further includes a power source voltage line L1, a reference voltage line L2, a reference voltage line L3, an applied voltage line L4, and a flag signal line L5.

The reference voltage supply circuit 13 supplies a reference voltage $Vref_{IO}$ as an example of a first reference voltage, and a reference voltage Vref as an example of a second reference voltage. The reference voltage $Vref_{IO}$ is supplied via the reference voltage line L2 to the VDD generator 14*a* that is arranged for the IO pads 1*a*. On the other hand, the reference voltage Vref is supplied via the reference voltage line L3 to the VDD generators 14*b* to 14*d* that are arranged for components other than the IO pads 1*a*. The VDD generator 14*a* for the IO pads 1*a* is an example of a first power source voltage generator, and the remaining VDD generators 14*b* to 14*d* are examples of a second power source voltage generator.

The power source voltage supply circuit 14 supplies a power source voltage VDD to the power source voltage line L1. In the present embodiment, the IO pads 1*a*, the RE pad 1*b*, and the BRE pad is are electrically connected to each other via the power source voltage line L1. The VDD generators 14*a* to 14*d* are electrically connected to each other via the power source voltage line L1. Further, the VDD generator 14*a* is electrically connected to the IO pads 1*a*, the RE pad 1*b*, and the BRE pad is via the power source voltage line L1. The VDD generator 14*b* is electrically connected to the controller 12 via the power source voltage line L1.

The VDD generator 14*a* is provided for the IO pads 1*a*, and generates the power source voltage VDD based on the reference voltage $Vref_{IO}$, and supplies the generated voltage to the IO pads is (and also to the RE and BRE pads 1*b* and 1*c*). The power source voltage VDD from the VDD generator 14*a* is an example of a first power source voltage. The VDD generators 14*b* to 14*d* are provided for the components other than the IO pads 1*a*, generate the power source voltage VDD based on the reference voltage Vref, and supply the generated voltage to portions other than the IO pads 1*a*. The power source voltage VDD from the VDD generators 14*b* to 14*d* is an example of a second power source voltage. In the present embodiment, the power source voltage VDD from the VDD generator 14*b* is supplied to the controller 12, and the power source voltage VDD from the VDD generators 14*c* and 14*d* is supplied to arithmetic circuits in the NAND chip 1.

The determination circuit 15 compares the voltage on the power source voltage line L1 (power source voltage VDD) with the voltage on the applied voltage line L4 (applied voltage Vapp), and outputs a flag signal FLG indicating a result of the comparison to the flag signal line L5. For example, when the power source voltage VDD from the VDD generator 14*a* is supplied to the power source voltage line L1, the determination circuit 15 compares the power source voltage VDD from the VDD generator 14*a* with the applied voltage Vapp, and outputs the flag signal FLG indicating the comparison result. The applied voltage Vapp is an example of the voltage for comparison, and the flag signal FLG is an example a signal indicating the comparison result.

The controller 12 receives the flag signal FLG from the flag signal line L5, and controls the value of the reference voltage $Vref_{IO}$ and the value of the reference voltage Vref based on the flag signal FLG. In the present embodiment, trimming processing for the NAND chip 1 is performed by controlling the values of the reference voltages $Vref_{IO}$ and Vref. The tester 2 controls operations of the controller 12 in the trimming processing. The determination circuit 15 and the controller 12 are an example of a voltage control circuit.

Details of the controller 12, the reference voltage supply circuit 13, the power source voltage supply circuit 14, and the determination circuit 15, and details of the trimming processing will be described below with reference to FIG. 2.

Figure 2:
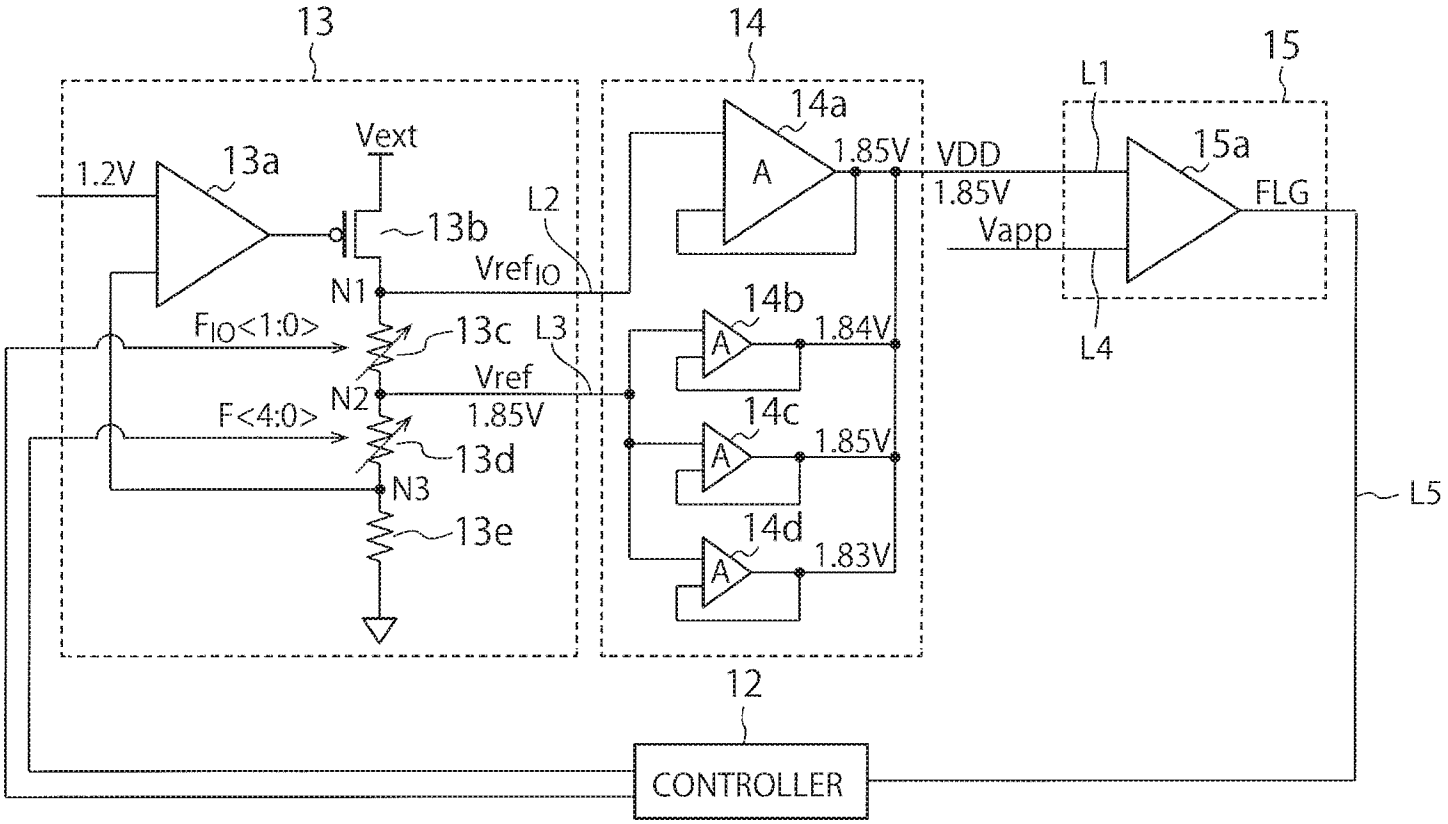
FIG. 2 is a circuit diagram illustrating a configuration of a part of the NAND chip of the first embodiment.

FIG. 2 is a circuit diagram illustrating a configuration of a part of the NAND chip 1 of the first embodiment.

FIG. 2 illustrates the controller 12, the reference voltage supply circuit 13, the power source voltage supply circuit 14, and the determination circuit 15 of the present embodiment, similar to FIG. 1. FIG. 2 further illustrates the reference voltage line L2 that supplies the reference voltage $Vref_{IO}$ from the reference voltage supply circuit 13 to the VDD generator 14*a*, the reference voltage line L3 that supplies the reference voltage Vref from the reference voltage supply circuit 13 to the VDD generators 14*b* to 14*d*, the power source voltage line L1 that supplies the power source voltage VDD from the VDD generators 14*a* to 14*d* to the determination circuit 15, the applied voltage line L4 that supplies the applied voltage Vapp to the determination circuit 15, and the flag signal line L5 that transmits the flag signal FLG from the determination circuit 15 to the controller 12.

The reference voltage supply circuit 13 includes a comparator 13*a*, a MOS transistor 13*b*, a variable resistor 13*c* that is an example of a first variable resistor, a variable resistor 13*d* that is an example of a second variable resistor, and a fixed resistor 13*e*. The MOS transistor 13*b*, the variable resistor 13*c*, the variable resistor 13*d*, and the fixed resistor 13*e* are connected in series between an external voltage Vext and the ground voltage. FIG. 2 illustrates a node N1 between the MOS transistor 13*b* and the variable resistor 13*c*, a node N2 between the variable resistor 13*c* and the variable resistor 13*d*, and a node N3 between the variable resistor 13*d* and the fixed resistor 13*e*. The node N1 is an example of a first node, the node N2 is an example of a second node, and the node N3 is an example of a third node.

The comparator 13*a* has a first input terminal to which a constant voltage (e.g., 1.2 V) is supplied, a second input terminal connected to the node N3, and an output terminal that outputs a comparison result between an input voltage of the first input terminal and an input voltage of the second input terminal. The MOS transistor 13*b* is, for example, a pMOS, which has a gate terminal connected to the output terminal of the comparator 13*a*, a source terminal disposed on the external voltage Vext side, and a drain terminal disposed on the node N1 side.

The variable resistor 13*c* is provided for generating the reference voltage $Vref_{IO}$ at the node N1, and is arranged between the node N1 and the node N2. In the present embodiment, the value of the reference voltage $Vref_{IO}$ may be changed by changing the resistance value of the variable resistor 13*c*. The reference voltage supply circuit 13 of the present embodiment supplies the reference voltage $Vref_{IO}$ from the node N1 to the VDD generator 14*a*.

The variable resistor 13*d* is provided for generating the reference voltage Vref at the node N2, and is arranged between the node N2 and the node N3. In the present embodiment, the value of the reference voltage Vref may be changed by changing the resistance value of the variable resistor 13*d*. The reference voltage supply circuit 13 of the present embodiment supplies the reference voltage Vref from the node N2 to the VDD generators 14*b* to 14*d*.

The fixed resistor 13*e* is provided for giving an influence to the voltage of the node N3, and is arranged between the node N3 and the ground voltage. The voltage of the node N3 is supplied to the second input terminal of the comparator 13*a*.

Each of the VDD generators 14*a* to 14*d* is a unity gain buffer configured by an operational amplifier. Accordingly, the operational amplifier configuring each of the VDD generators 14*a* to 14*d* includes a first input terminal connected to the reference voltage supply circuit 13 to receive the reference voltage $Vref_{IO}$ or the reference voltage Vref, an output terminal connected to the determination circuit 15 to output the power source voltage VDD, and a second input terminal connected to this output terminal to configure a feedback circuit. The VDD generators 14*a* to 14*d* are arranged in parallel with each other between the reference voltage supply circuit 13 and the determination circuit 15. FIG. 2 illustrates 1.85 V, 1.84 V, 1.85 V, and 1.83 V as exemplary offset voltages of the operational amplifiers of the VDD generators 14*a* to 14*d*.

The determination circuit 15 includes a comparator 15*a*. The comparator 15*a* includes a first input terminal to which the voltage of the power source voltage line L1 is supplied, a second input terminal to which the applied voltage Vapp is supplied, and an output terminal that outputs the flag signal FLG indicating a comparison result between an input voltage of the first input terminal and an input voltage of the second input terminal. The flag signal FLG of the present embodiment becomes 0 (low) when the voltage of the power source voltage line L1 is lower than the applied voltage Vapp and becomes 1 (high) when the voltage of the power source voltage line L1 is equal to or greater than the applied voltage Vapp. In FIG. 2, the power source voltage VDD having been input from the power source voltage supply circuit 14 to the first input terminal of the determination circuit 15 is 1.85 V.

The controller 12 receives the flag signal FLG from the determination circuit 15 and controls, based on the flag signal FLG, the value of the reference voltage $Vref_{IO}$ and the value of the reference voltage Vref. Specifically, the controller 12 controls the value of the reference voltage $Vref_{IO}$ by outputting a control signal $F_{IO}$<1:0> for controlling the resistance value of the variable resistor 13*c* and controls the value of the reference voltage Vref by outputting a control signal F<4:0> for controlling the resistance value of the variable resistor 13*d*.

When performing the trimming processing using the reference voltage Vref, the controller 12 operates in the following manner. When the flag signal FLG is low, the controller 12 counts up the value of the control signal F so that the resistance value of the variable resistor 13*d* increases with elapsing time. When the control signal F is transmitted to the variable resistor 13*d*, the resistance value of the variable resistor 13*d* increases with elapsing time. As a result, the value of the reference voltage Vref increases with elapsing time. Subsequently, when the flag signal FLG changes to high, the trimming processing using the reference voltage Vref terminates.

Similarly, when performing the trimming processing using the reference voltage $Vref_{IO}$, the controller 12 operates in the following manner. When the flag signal FLG is low, the controller 12 counts up the value of the control signal $F_{IO}$ so that the resistance value of the variable resistor 13*c* increases with elapsing time. When the control signal $F_{IO}$ is transmitted to the variable resistor 13*c*, the resistance value of the variable resistor 13*c* increases with elapsing time. As a result, the value of the reference voltage $Vref_{IO}$ increases with elapsing time. Subsequently, when the flag signal FLG changes to high, the trimming processing using the reference voltage $Vref_{IO}$ terminates.

The trimming processing using the reference voltages Vref and $Vref_{IO}$ will be described in detail below.

Figure 3:
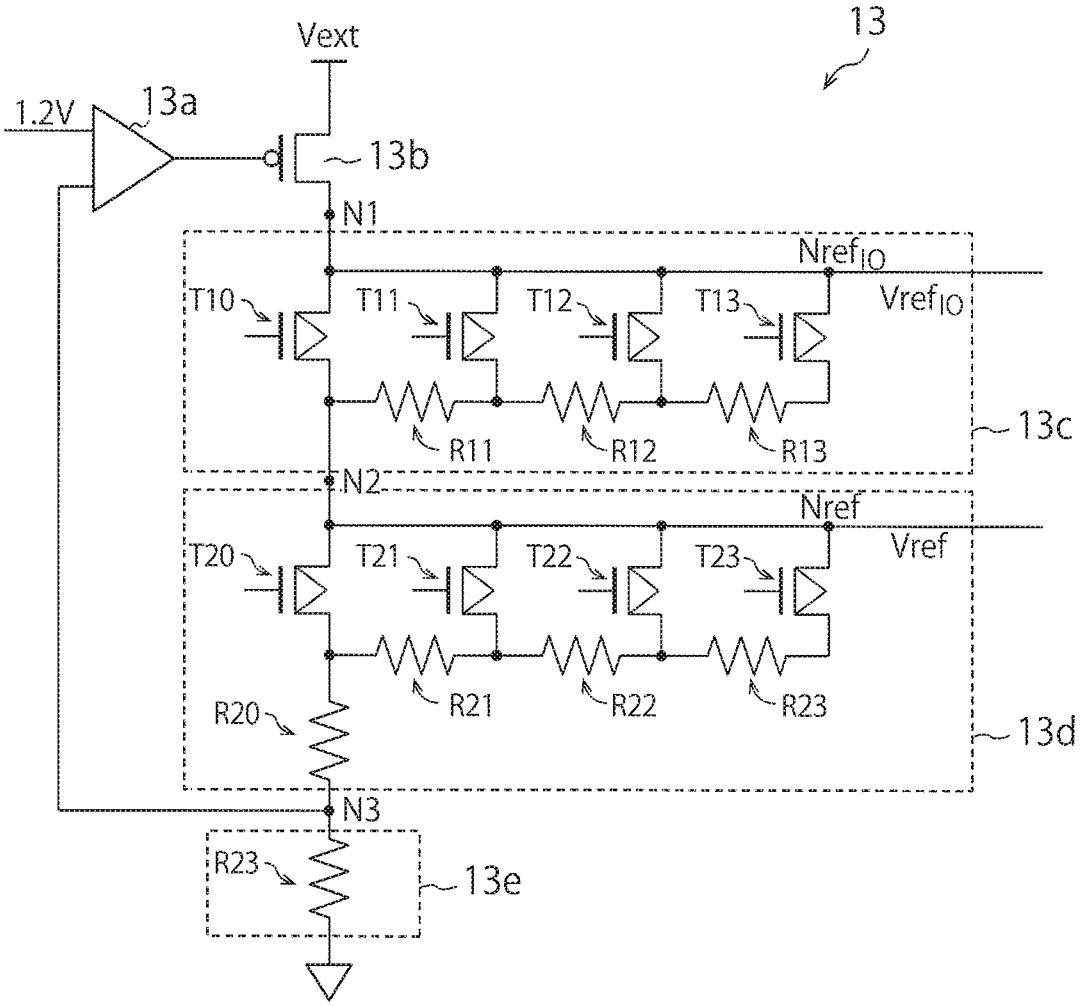
FIG. 3 is a circuit diagram illustrating a configuration of a reference voltage supply circuit of the first embodiment.

FIG. 3 is a circuit diagram illustrating a configuration of the reference voltage supply circuit 13 of the first embodiment. For example, the variable resistor 13*c*, the variable resistor 13*d*, and the fixed resistor 13*e* of the present embodiment may be configured as illustrated in FIG. 3.

The variable resistor 13*c* includes four MOS transistors T10, T11, T12, and T13, and three resistors R11, R12, and R13. The MOS transistors T10, T11, T12, and T13 are arranged in parallel with each other between the node N1 and the node N2. The resistor R11 is arranged between the MOS transistors T10 and T11. The resistor R12 is arranged between the MOS transistors T11 and T12. The resistor R13 is arranged between the MOS transistors T12 and T13. FIG. 3 further illustrates a node $Nref_{IO}$ between the node N1 and the MOS transistor T13. The voltage of the node $Nref_{IO}$ is the reference voltage $Vref_{IO}$ and is the same as that of the node N1. The node N1 is electrically connected to the VDD generator 14*a* via the node $Nref_{IO}$. The number of the MOS transistors in the variable resistor 13*c* may be other than four, and the number of the resistors in the variable resistor 13*c* may be other than three.

As illustrated in FIG. 3, the MOS transistors T10 to T13 and the resistors R11 to R13 in the variable resistor 13*c* configure a digital analog converter (DAC). Accordingly, when a digital signal is input to gate terminals of the MOS transistors T10 to T13, an analog signal converted from the digital signal is output from the variable resistor 13*c*.

The controller 12 (FIG. 2) of the present embodiment outputs the control signal $F_{IO}$ for controlling the resistance value of the variable resistor 13*c*. The control signal $F_{IO}$ is a digital signal indicating a digital value corresponding to the resistance value of the variable resistor 13*c* and is input to the gate terminals of the MOS transistors T10 to T13. As a result, the resistance value of the variable resistor 13*c* changes to the digital value indicated by the control signal $F_{IO}$, and the reference voltage $Vref_{IO}$ changes correspondingly. The reference voltage $Vref_{IO}$ corresponds to the above-described analog signal. In this manner, the variable resistor 13*c* converts the digital value indicating the value of the control signal $F_{IO}$ into the analog value indicating the value of the reference voltage $Vref_{IO}$.

The variable resistor 13*d* includes four MOS transistors T20, T21, T22, and T23 and four resistors R20, R21, R22, and R23. The MOS transistors T20, T21, T22, and T23 are arranged in parallel with each other between the node N2 and the node N3. The resistor R20 is arranged between the node N3 and the MOS transistor T20. The resistor R21 is arranged between the MOS transistors T20 and T21. The resistor R22 is arranged between the MOS transistors T21 and T22. The resistor R23 is arranged between the MOS transistors T22 and T23. FIG. 3 further illustrates a node Nref between the node N2 and the MOS transistor T23. The voltage of the node Nref is the reference voltage Vref and is the same as that of the node N2. The node N2 is electrically connected to the VDD generators 14*b* to 14*d* via the node Nref. The number of the MOS transistors in the variable resistor 13*d* may be other than four, and the number of the resistors in the variable resistor 13*d* may be other than four.

As illustrated in FIG. 3, the MOS transistors T20 to T23 and the resistors R21 to R23 in the variable resistor 13*d* configure a DAC. Accordingly, when a digital signal is input to gate terminals of the MOS transistors T20 to T23, an analog signal converted from the digital signal is output from the variable resistor 23*d*.

The controller 12 of the present embodiment outputs the control signal F for controlling the resistance value of the variable resistor 13*d*. The control signal F is a digital signal indicating a digital value corresponding to the resistance value of the variable resistor 13*d* and is input to the gate terminals of the MOS transistors T20 to T23. As a result, the resistance value of the variable resistor 13*d* changes to the digital value indicated by the control signal F, and the reference voltage Vref changes correspondingly. The reference voltage Vref corresponds to the above-described analog signal. In this manner, the variable resistor 13*d* converts the digital value indicating the value of the control signal F into the analog value indicating the value of the reference voltage Vref.

The fixed resistor 13*e* includes one resistor R30. The resistor R30 is arranged between the node N3 and the ground voltage. Two or more resistors may be provided in the fixed resistor 13*e*.

Next, the trimming processing using the reference voltages Vref and $Vref_{IO}$ will be described again with reference to FIG. 2.

The trimming processing of the present embodiment includes first trimming processing to be performed using the reference voltage Vref and second trimming processing to be subsequently performed using the reference voltage $Vref_{IO}$. In the first trimming processing, all the VDD generators 14*a* to 14*d* are trimmed using the reference voltage Vref. In the second trimming processing, only the VDD generator 14*a* among the VDD generators 14*a* to 14*d* is trimmed using the reference voltage $Vref_{IO}$.

In the first trimming processing, the resistance value of the variable resistor 13*c* is fixed to zero and the resistance value of the variable resistor 13*d* is caused to increase with elapsing time. Accordingly, the value of the reference voltage Vref increases with elapsing time. On the other hand, since the variable resistor 13*c* is zero, the value of the reference voltage $Vref_{IO}$ becomes equal to the value of the reference voltage Vref ($Vref_{IO}$=Vref). Accordingly, the reference voltage Vref that increases with elapsing time is supplied to the VDD generators 14*b* to 14*d*. The reference voltage $Vref_{IO}$, which is the same as the reference voltage Vref, is supplied to the VDD generator 14*a*. That is, in the first trimming processing, the same reference voltage Vref is supplied to all the VDD generators 14*a* to 14*d*.

In the first trimming processing, all the VDD generators 14*a* to 14*d* are operated to perform trimming to 1.85 V. Specifically, by counting up the value of the control signal F, the reference voltage Vref is caused to increase with elapsing time and the power source voltage VDD to be input to the determination circuit 15 is caused to increase so as to reach 1.85 V. On the other hand, the applied voltage Vapp is set to 1.85 V. Accordingly, when the power source voltage VDD reaches 1.85 V, the value of the flag signal FLG changes from 0 to 1. In the first trimming processing, the value of the control signal F at the time when the power source voltage VDD has reached 1.85 V is determined as a trim value. The trim value is stored inside or outside the NAND chip 1.

In the second trimming processing, the value of the control signal F is fixed to the above-described trim value and, while the resistance value of the variable resistor 13*d* is fixed, the resistance value of the variable resistor 13*c* is caused to increase with elapsing time. Accordingly, the reference voltage $Vref_{IO}$ becomes higher than the reference voltage Vref ($Vref_{IO}$>Vref), and the value of the reference voltage $Vref_{IO}$ increases with elapsing time. In the second trimming processing, the reference voltage $Vref_{IO}$ higher than the reference voltage Vref is supplied to the VDD generator 14*a*.

In the second trimming processing, only the VDD generator 14*a* among the VDD generators 14*a* to 14*d* is operated to perform trimming to 1.85 V. Specifically, by counting up the value of the control signal $F_{IO}$, the reference voltage $Vref_{IO}$ is caused to increase with elapsing time and the power source voltage VDD to be input to the determination circuit 15 is caused to increase so as to reach 1.85 V. On the other hand, the applied voltage Vapp is set to 1.85 V. Accordingly, when the power source voltage VDD reaches 1.85 V, the value of the flag signal FLG changes from 0 to 1. In the second trimming processing, the value of the control signal $F_{IO}$ at the time when the power source voltage VDD has reached 1.85 V is determined as the trim value. The trim value is stored inside or outside the NAND chip 1.

Next, a comparative example of the NAND chip 1 of the first embodiment will be described. Advantages of the trimming processing of the first embodiment will be described through comparison between the first embodiment and the comparative example.

Figure 4:
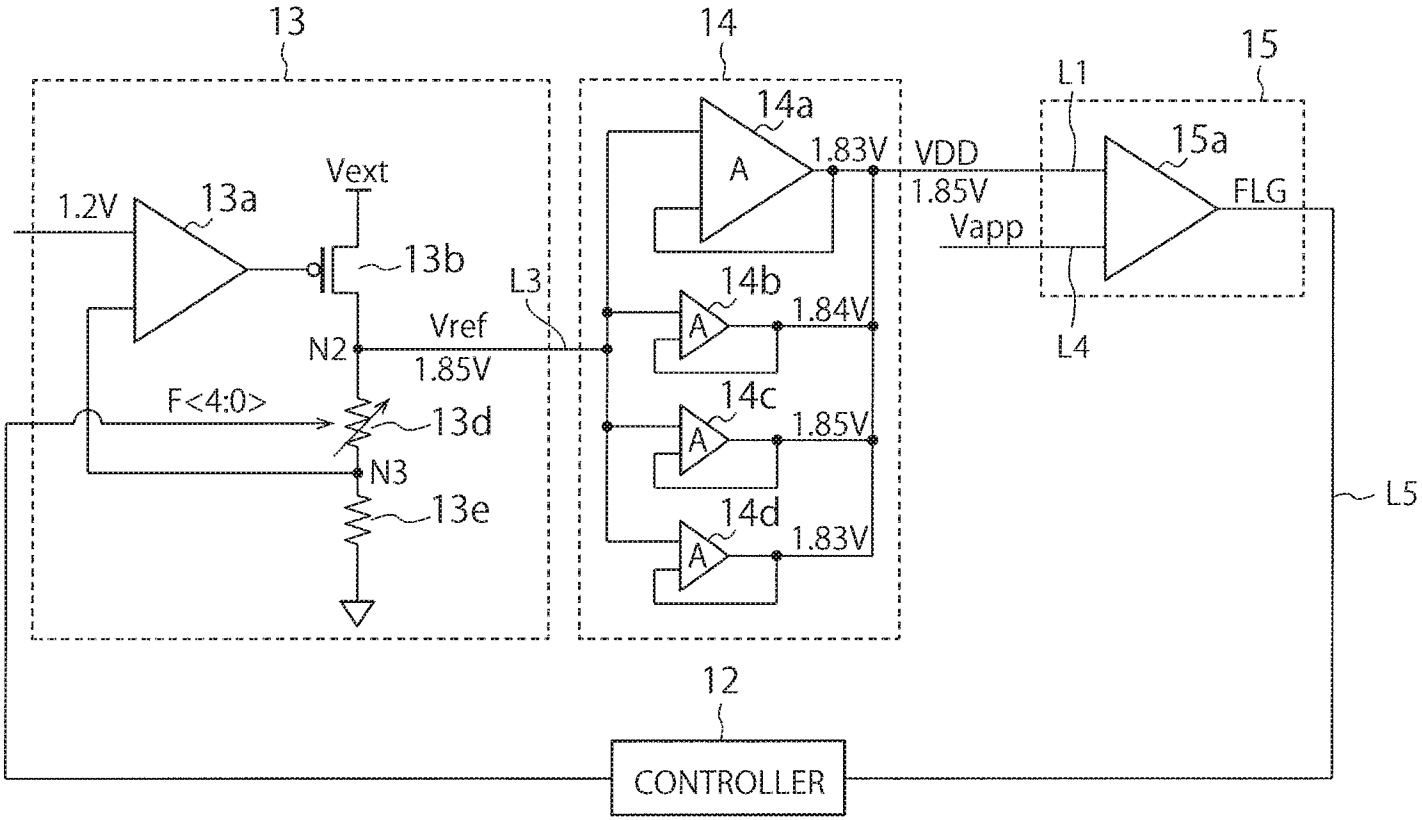
FIG. 4 is a circuit diagram illustrating a configuration of a part of a NAND chip of a comparative example of the first embodiment.

FIG. 4 is a circuit diagram illustrating a configuration of a part of the comparative example of the NAND chip 1 of the first embodiment.

In the NAND chip 1 of this comparative example, the configuration illustrated in FIG. 2 is replaced by the configuration illustrated in FIG. 4. FIG. 4 illustrates a controller 12, a reference voltage supply circuit 13, a power source voltage supply circuit 14, and a determination circuit 15 of the comparative example.

The reference voltage supply circuit 13 of the comparative example does not include the variable resistor 13*c*. Accordingly, a node N2 of the reference voltage supply circuit 13 is electrically connected not only to VDD generators 14*b* to 14*d* but also to a VDD generator 14*a*. The reference voltage Vref is supplied to all the VDD generators 14*a* to 14*d*. FIG. 4 illustrates 1.83 V, 1.84 V, 1.85 V, and 1.83 V as exemplary offset voltages of the operational amplifiers of the VDD generators 14*a* to 14*d*. The trimming processing of the comparative example includes only the first trimming processing using the reference voltage Vref.

Figure 5A:
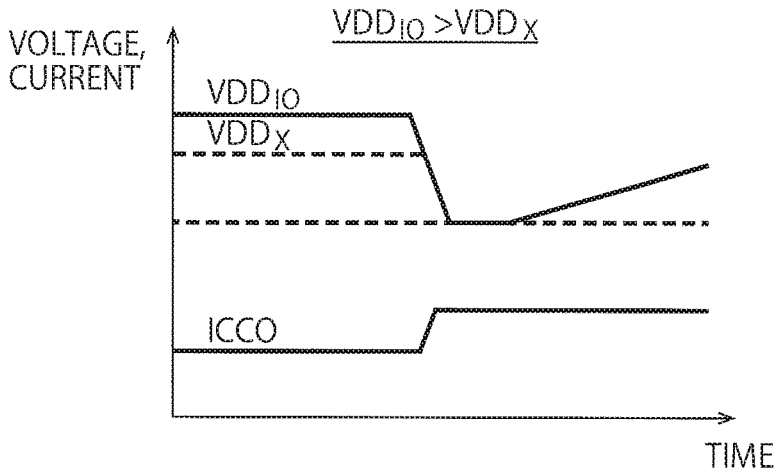
FIGS. 5A and 5B are graphs illustrating operations of the NAND chip of the comparative example illustrated in FIG. 4.
Figure 5B:
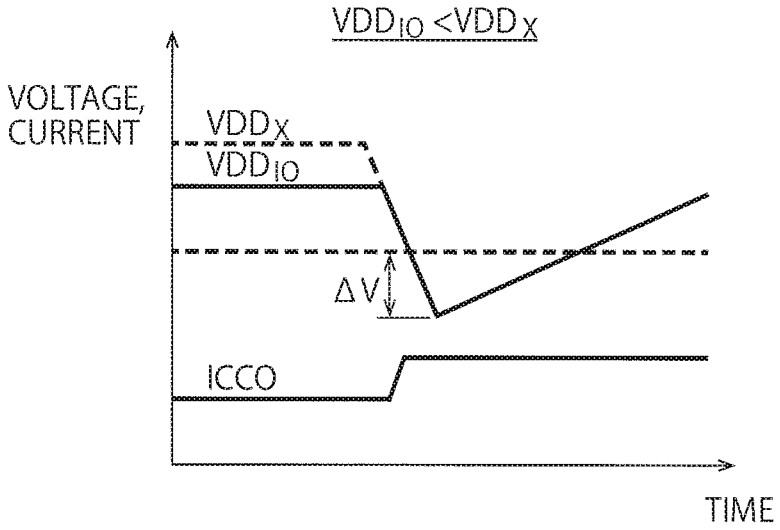

FIGS. 5A and 5B are graphs illustrating operations of the comparative example of the NAND chip 1 illustrated in FIG. 4.

Each of FIGS. 5A and 5B illustrates temporal changes of $VDD_{IO}$ that represents the power source voltage VDD supplied from the VDD generator 14*a* for the IO pads 1*a*, $VDD_X$ that represents the power source voltage VDD supplied from any one of the remaining VDD generators 14*b* to 14*d*, and ICCO that represents the consumption current of the NAND chip 1. FIG. 5A illustrates temporal changes in the case of $VDD_{IO}$>$VDD_X$ and FIG. 5B illustrates temporal changes in the case of $VDD_{IO}$<$VDD_X$.

In the trimming processing (i.e., the first trimming processing) of the comparative example, all the VDD generators 14*a* to 14*d* are simultaneously trimmed in the state where the consumption current of the NAND chip 1 is zero. Therefore, when there is a difference in the value of the supplied power source voltage VDD among the VDD generators 14*a* to 14*d*, trimming suitable for the VDD generator supplying the highest power source voltage VDD is performed.

Accordingly, when the VDD generator 14*a* for the IO pads 1*a* supplies the highest power source voltage VDD, trimming suitable for the VDD generator 14*a* is performed (see FIG. 5A). On the other hand, when any one of the remaining VDD generators 14*b* to 14*d* supplies the highest power source voltage VDD, trimming that is not suitable for the VDD generator 14*a* may be performed (see FIG. 5B). FIG. 5B illustrates a state where the power source voltage VDD of the VDD generator 14*a* greatly drops as indicated by the symbol ΔV when the consumption current of the NAND chip 1 steeply increases.

It is considered that the speed of input/output signals at the IO pads 1*a* increases as the generation of the NAND chip 1 advances. Accordingly, inappropriately trimming the VDD generator 14*a* for the IO pads 1*a* is not desired. On the other hand, simultaneously trimming a plurality of VDD generators is desired to efficiently perform the trimming processing.

Therefore, the trimming processing of the present embodiment includes the first trimming processing for simultaneously trimming all the VDD generators 14*a* to 14*d* and the second trimming processing for trimming only the VDD generator 14*a* for the IO pads 1*a*. This makes it possible to efficiently perform the trimming processing while appropriately trimming the VDD generator 14*a* for the IO pads 1*a*.

Figure 6A:
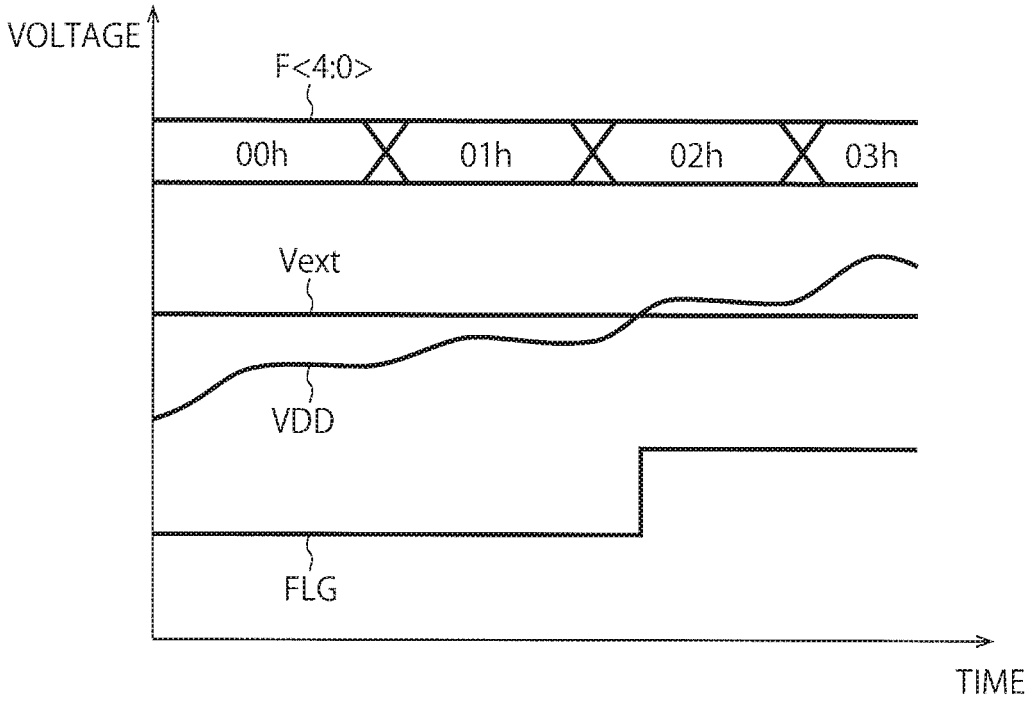
FIGS. 6A and 6B are graphs illustrating operations of the NAND chip of the first embodiment.
Figure 6B:
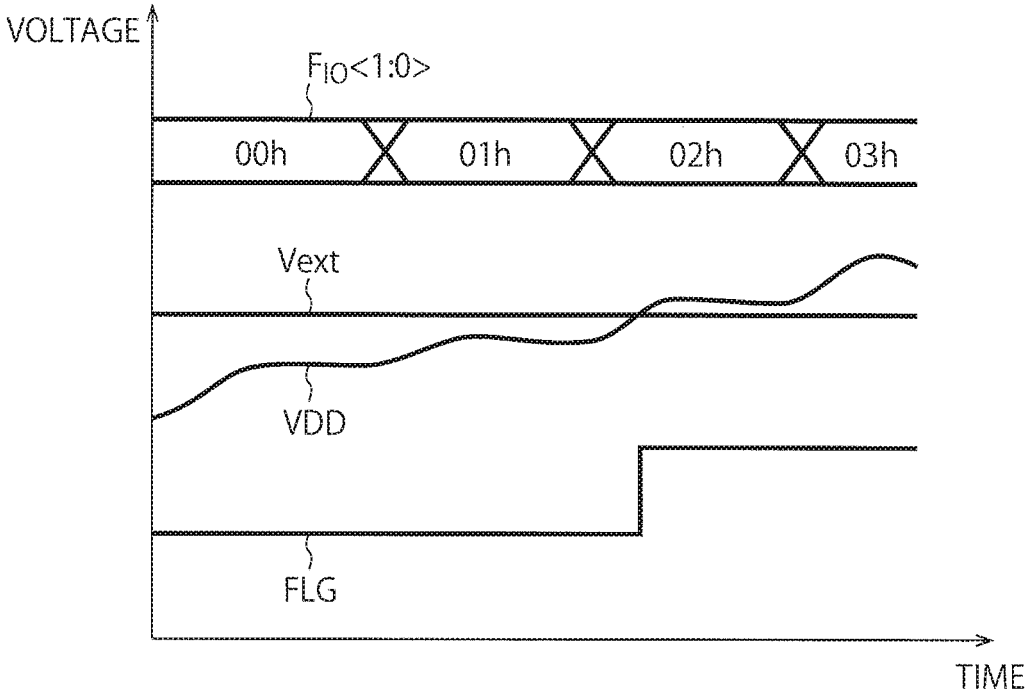

FIGS. 6A and 6B are graphs illustrating operations of the NAND chip 1 of the first embodiment.

FIG. 6A illustrates the temporal change of each signal in the first trimming processing, more specifically, the control signal F input to the variable resistor 13*d*, the applied voltage Vapp input to the determination circuit 15, the power source voltage VDD input to the determination circuit 15, and the flag signal FLG output from the determination circuit 15.

In the first trimming processing, the power source voltage VDD increases with elapsing time by counting up the control signal F. When the power source voltage VDD reaches the applied voltage Vapp (e.g., 1.85 V), the flag signal FLG changes from 0 to 1. In the first trimming processing, the value of the control signal F at the time when the power source voltage VDD has reached the applied voltage Vapp is determined as the trim value.

FIG. 6B illustrates the temporal change of each signal in the second trimming processing, more specifically, the control signal $F_{IO}$ input to the variable resistor 13*c*, the applied voltage Vapp input to the determination circuit 15, the power source voltage VDD input to the determination circuit 15, and the flag signal FLG output from the determination circuit 15.

In the second trimming processing, the power source voltage VDD from the VDD generator 14*a* increases with elapsing time by counting up the control signal $F_{IO}$ while fixing the value of the control signal F to the trim value. When the power source voltage VDD reaches the applied voltage Vapp (e.g., 1.85 V), the flag signal FLG changes from 0 to 1. In the second trimming processing, the value of the control signal $F_{IO}$ at the time when the power source voltage VDD has reached the applied voltage Vapp is determined as the trim value.

Figure 7A:
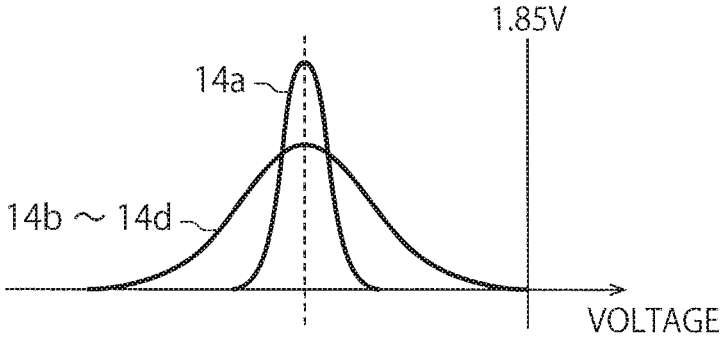
FIGS. 7A and 7B are additional graphs illustrating operations of the NAND chip of the first embodiment.
Figure 7B:
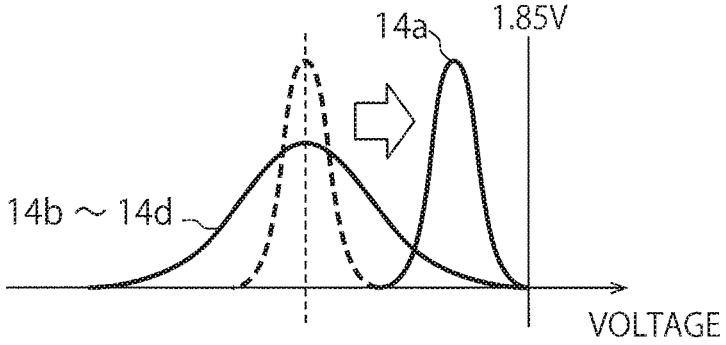

FIGS. 7A and 7B are additional graphs illustrating operations of the NAND chip 1 of the first embodiment.

FIG. 7A illustrates distributions of the power source voltage VDD after the first trimming, and FIG. 7B illustrates distributions of the power source voltage VDD after the second trimming. Specifically, FIGS. 7A and 7B illustrate distributions of the power source voltage VDD supplied from the VDD generator 14*a* for the IO pads 1*a* and distributions of the power source voltage VDD supplied from the remaining VDD generators 14*b* to 14*d*.

FIG. 7A illustrates the distribution of the power source voltage VDD of the VDD generator 14*a* that does not reach 1.85 V, as an inappropriate trimming result for the VDD generator 14*a*. On the other hand, FIG. 7B illustrates the distribution of the power source voltage VDD of the VDD generator 14*a* that reaches 1.85 V, as an appropriate trimming result for the VDD generator 14*a*. Therefore, when the consumption current of the NAND chip 1 steeply increases, the power source voltage VDD of the VDD generator 14*a* can be suppressed from dropping.

FIG. 4 (comparative example) illustrates 1.83 V as an example of the offset voltage of the VDD generator 14*a*, FIG. 2 (first embodiment) illustrates 1.85 V as an example of the offset voltage of the VDD generator 14*a*. In the comparative example, the offset voltage becomes 1.83 V because of the first trimming processing. On the other hand, in the first embodiment, after the offset voltage has once become 1.83 V through the first trimming processing, the offset voltage becomes 1.85 V because of the second trimming processing. Therefore, the result illustrated in FIG. 7B can be obtained.

As described above, the NAND chip 1 of the present embodiment includes the reference voltage supply circuit 13 that supplies the power source voltage Vref to the VDD generators 14*b* to 14*d* and also supplies the power source voltage $Vref_{IO}$ to the VDD generator 14*a*. Therefore, according to the present embodiment, it is possible to efficiently trim all the VDD generators 14*a* to 14*d* while appropriately trimming the VDD generator 14*a*. Therefore, the plurality of VDD generators 14*a* to 14*d* can be appropriately trimmed.

In the present embodiment, the power source voltage supply circuit 14 includes four VDD generators 14*a* to 14*d*, but may include N VDD generators where N is an integer of two or more. In this case, the trimming processing may include first trimming processing for trimming all the N VDD generators and second trimming processing for trimming only one of the N VDD generators. In the second trimming processing, two or more of the N VDD generators may be trimmed.

Although the VDD generator 14*a* for the IO pads 1*a* is subjected to the second trimming processing of the present embodiment, a VDD generator for anything but the IO pads 1*a* may be subjected to the second trimming processing.

While certain embodiments have been described, these embodiments have been presented by way of example only, and are not intended to limit the scope of the inventions. Indeed, the novel devices and methods described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

The invention claimed is:

1. A semiconductor device comprising:

a reference voltage supply circuit configured to supply a first reference voltage and a second reference voltage;

a power source voltage supply circuit including a first power source voltage generator supplied with the first reference voltage and configured to generate a first power source voltage, and a second power source voltage generator supplied with the second reference voltage and configured to generate a second power source voltage, the power source voltage supply circuit being configured to supply the first power source voltage and the second power source voltage to a power source voltage line; and a voltage control circuit connected to the power source voltage line, and configured to control a value of the first reference voltage and a value of the second reference voltage, wherein:

the reference voltage supply circuit includes a first variable resistor configured to change the value of the first reference voltage, and a second variable resistor configured to change the value of the second reference voltage, the first variable resistor is provided between a first node and a second node, the second variable resistor is provided between the second node and a third node, and the reference voltage supply circuit supplies the first reference voltage from the first node to the first power source voltage generator, and supplies the second reference voltage from the second node to the second power source voltage generator.

2. The device of claim 1, wherein each of the first variable resistor and the second variable resistor configures a digital analog converter including a plurality of transistors and a plurality of resistances.

3. The device of claim 1, wherein the first variable resistor and the second variable resistor are connected in series.

4. The device of claim 1, wherein the voltage control circuit controls the value of the first reference voltage by controlling a resistance value of the first variable resistor, and controls the value of the second reference voltage by controlling a resistance value of the second variable resistor.

5. The device of claim 1, wherein the voltage control circuit controls the value of the second reference voltage when trimming the first and second power source voltage generators, and controls the value of the first reference voltage when trimming only the first power source voltage generator of the first and second power source voltage generators.

6. The device of claim 1, wherein the voltage control circuit includes:

a determination circuit configured to compare a voltage on the power source voltage line with a voltage for comparison, and output a signal indicating a result of the comparison, and a controller supplied with the signal from the determination circuit, and configured to control the value of the first reference voltage and the value of the second reference voltage.

7. The device of claim 1, wherein:

the first power source voltage is a power source voltage for an input/output pad of the semiconductor device, and the second power source voltage is a power source voltage for a pad other than the input/output pad of the semiconductor device.

8. The device of claim 1, wherein each of the first and second power source voltage generators is a unity gain buffer.

9. A voltage supplying method comprising:

supplying a first reference voltage and a second reference voltage;

generating a first power source voltage from a first power source voltage generator to which the first reference voltage is supplied, generating a second power source voltage from a second power source voltage generator to which the second reference voltage is supplied, and supplying the first power source voltage and the second power source voltage to a power source voltage line; and controlling a value of the first reference voltage and a value of the second reference voltage by a voltage control circuit connected to the power source voltage line, wherein:

the method further comprises changing the value of the first reference voltage with a first variable resistor, and changing the value of the second reference voltage with a second variable resistor, the first variable resistor is provided between a first node and a second node, the second variable resistor is provided between the second node and a third node, and the first reference voltage is supplied from the first node to the first power source voltage generator, and the second reference voltage is supplied from the second node to the second power source voltage generator.

10. The method of claim 9, wherein each of the first variable resistor and the second variable resistor configures a digital analog converter including a plurality of transistors and a plurality of resistances.

11. The method of claim 9, wherein the first variable resistor and the second variable resistor are connected in series.

12. The method of claim 9, wherein the voltage control circuit controls the value of the first reference voltage by controlling a resistance value of the first variable resistor, and controls the value of the second reference voltage by controlling a resistance value of the second variable resistor.

13. The method of claim 9, wherein the voltage control circuit controls the value of the second reference voltage when trimming the first and second power source voltage generators, and controls the value of the first reference voltage when trimming only the first power source voltage generator of the first and second power source voltage generators.

14. The method of claim 9, wherein the voltage control circuit includes:

a determination circuit configured to compare a voltage on the power source voltage line with a voltage for comparison, and output a signal indicating a result of the comparison, and a controller supplied with the signal from the determination circuit, and configured to control the value of the first reference voltage and the value of the second reference voltage.

15. The method of claim 9, wherein:

the first power source voltage is a power source voltage for an input/output pad of the semiconductor device, and the second power source voltage is a power source voltage for a pad other than the input/output pad of the semiconductor device.

16. The method of claim 9, wherein each of the first and second power source voltage generators is a unity gain buffer.

* * * * *